United States Patent [19]

Lancellotti

[11] 4,373,568

[45] Feb. 15, 1983

[54] REDUCIBLE VOLUME SUN-BLIND

[75] Inventor: Enrico Lancellotti, Casalecchio di Reno, Italy

[73] Assignee: Sunfilter S.r.l., Bologna, Italy

[21] Appl. No.: 152,842

[22] Filed: May 23, 1980

[30] Foreign Application Priority Data

Jun. 7, 1979 [IT] Italy ..... 48563/79[U]

[51] Int. Cl.[3] ..... E05D 15/00; E06B 7/086

[52] U.S. Cl. ..... 160/184; 49/90; 160/377

[58] Field of Search ..... 160/168, 136, 137, 152, 160/153, 174, 175, 179, 113-117, 377, 379, 218, 223, 184; 49/74, 75, 86, 90

[56] References Cited

U.S. PATENT DOCUMENTS 343,881 6/1886 Williams ..... 49/90 X
410,441 9/1889 Perkins ..... 49/74
1,378,904 5/1921 Schuermann ..... 160/377 X
3,211,264 10/1965 Streeter, Jr. ..... 160/107 UX

FOREIGN PATENT DOCUMENTS 657162 4/1979 U.S.S.R. ..... 49/74

*Primary Examiner*—Philip C. Kannan
*Attorney, Agent, or Firm*—Fleit & Jacobson

[57] ABSTRACT

Disclosed herein is a reducible volume sun-blind with which, thanks to its simple yet functional means of adjustment, it is possible to constantly regulate the extent to which direct luminous radiation can pass therethrough. The support frame of the sun-blind is in the form of an articulated parallelogram, with a mechanism being provided to stabilize it in any one of the configurations thereof. The frame is provided with a plurality of parallel strips, elastic rods for retaining the latter under tension, a mechanism for synchronously rotating the strips, and a mechanism for stabilizing them in a plurality of positions.

9 Claims, 6 Drawing Figures

A
B
2a
2b
3a
3b
6
6a
6b
7
8
9
10
11
13
15
19

REDUCIBLE VOLUME SUN-BLIND

BACKGROUND OF THE INVENTION

This application relates to a reducible volume sun-blind suited, in particular, for use in motor vehicles.

DESCRIPTION OF THE PRIOR ART

In order to limit the adverse effects of solar rays that pass through the glass of motor vehicles, such as an increase in temperature and excessive brightness in the inside thereof, and the possibility of the occupants therein being dazzled, etcetera, users of motor vehicles have adopted a variety of constructional solutions, the best known of which are, in brief, the use of what is known as "blue tinted" glass, and the fitting to the glass in the inside of the vehicle, of sun-blinds; with the latter method it is possible to prevent persons looking at the vehicle from the sides or the back thereof from seeing in, and this to a partial (or even total) extent.

Sun-blinds are presently utilized that consist of a sheet, one extremity of which is integral with a drum. The said sheet that is unwound from the said drum and is wound there around in contrast with and with the aid of elastic means connected to the said drum, respectively, is made out of material of the type known as "filtra vedo" in which there are an infinity of small holes of a dimension such as to allow the occupants of the vehicle to see the objects outside. With the aforementioned sun-blinds the direct luminous radiation that passes therethrough is not prevented but is limited at the most to an average of 50%.

What are known as "Venetian blinds" are also used but although, on one hand, it is possible with these to constantly regulate from nought to 100% the amount of direct luminous radiation that passes therethrough they do, on the other hand, require the presence of various cords (and strips of material) in order to orient the slats synchronously and to reduce the latter to pack form, as well as a box in which the control mechanism to which the said cords (and strips of material) are connected, fits. The foregoing has a considerable effect on the cost of the blind which, with the slats reduced to pack form, has its minimum overall dimensions defined by the volume of the said pack and by that of the box, without, however, taking into consideration the operating cords that always protrude out of the said box.

SUMMARY OF THE INVENTION

The object of the invention is to make available a reducible volume sun-blind which, thanks to its simple yet functional means of adjustment, makes it possible to constantly regulate the extent to which direct luminous radiation can pass therethrough, and is able, furthermore, to be transformed, in a simple and rapid fashion, from its operational configuration to its reduced volume configuration.

The foregoing object is attained with the utility model described herein, in which consideration is given to a reducible volume sun-blind characterized by the fact that it is constituted by: an articulated parallelogram that defines the support frame for the blind; means for stabilizing the said parallelogram in any one of its configurations; and a plurality of parallel strips, the extremities of each of which are connected, rotatably with respect to the longitudinal axis of the individual strips, to two parallel sides of the parallelogram, with the interposition, between at least one extremity and the relevant side of the parallelogram, of elastic means for tensioning the said strips; means for synchronously rotating the said strips, with respect to their longitudinal axes, from a position practically coplanar with the surface defined by the said paarallelogram to a position at least perpendicular thereto; and means for stabilizing the said strips in a plurality of positions.

BRIEF DESCRIPTION OF THE DRAWINGS

In order to render more, clearly further characteristics and advantages of the invention, a detailed description is given hereinafter of a preferred but not sole form of embodiment for the blind in question, illustrated purely as an unlimited example on the accompanying drawings, in which.

DESCRIPTION OF THE PREFERRED EMBODIMENT

With reference to the above listed figures, at 5 is shown the support frame of the blind 10 in question. The said support frame is defined by an articulated parallelogram constituted by two pairs of parallel sides 2*a*–2*b* and 3*a*–3*b*, respectively.

The pivots 4 of the said parallelogram screw couple with wing nuts 4*a*, the purpose of this being to render stable any configuration adopted by the said parallelogram.

The extremities of the aforementioned sides are, in the parts destined to accept the pivots 4, bent slightly inwards, and the advantages derived from this particular form of construction will become apparent hereinafter.

Figure 5:
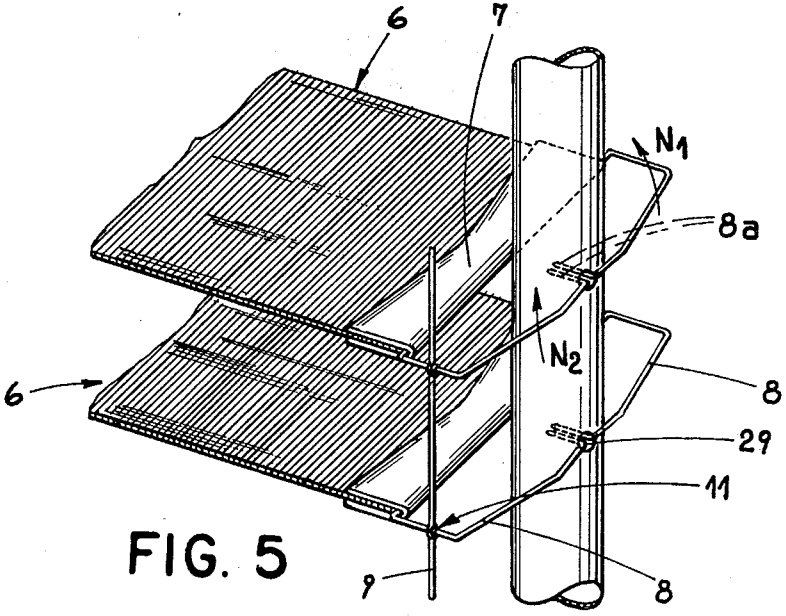
FIGS. 5 and 6 illustrate, in an enlarged scale with respect to the preceding figures, the details A and B, respectively, in FIG. 1.
Figure 6:
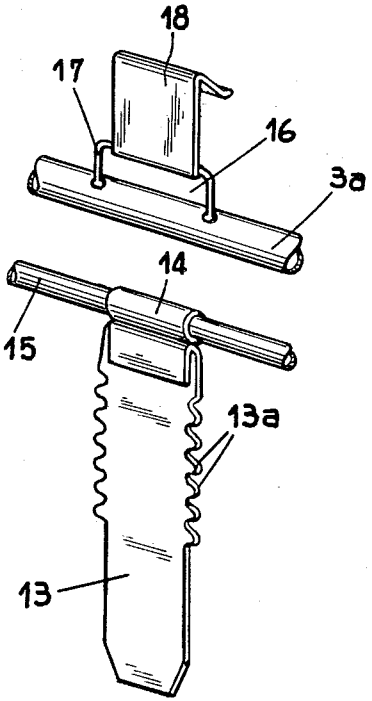

In between the two parallel sides 2*a*–2*b* is interposed a plurality of strips 6 which are parallel one with the other. Each strip is constituted by a flexible material (for example, elasticized material), the extremities of which are anchored between the limbs of corresponding plates 7 that are bent in the form of a "U". The individual plates 7 have fastened thereto two metal rods 8 that are arranged symmetrically with respect to the longitudinal axis of the strip concerned and are convergent, one with respect to the other, as can be seen in FIG. 5. The extremities 8*a* of the rods are bent towards the said strip and are freely inserted in a hole 29 made in the external part of the corresponding side 2*a* or 2*b*.

The two pairs of rods 8 have, for each strip, a dual function. The two pairs of rods make it possible, in fact, to keep the strip 6 in question taut (in the operational configuration of the blind, FIG. 1) and, furthermore, form a pivot connection with the corresponding sides 2*a*–2*b*. Each strip can, in fact, rotate with respect to its longitudinal axis.

So as to achieve the synchronous rotation of the strips 6 provision is made for two metal wires 9, located on one and the same side of the said parallelogram, each of which connects, one to the other, the rods positioned on the said side, which relate to the extremities of the said strips oriented in the same direction. The extremities of each of the said wires are connected to the rods 8 in respect of the upper extreme strip 6*a* and the lower extreme strip 6*b*, and each wire is bent the right number of times to suit the number of intermediate strips, in order to define the slots 11, each of which freely accepts the corresponding rod 8.

It thus ensues from the foregoing that when any one strip 6 is made to rotate with respect to its longitudinal axis in the direction $N_1$ or $N_2$, the synchronous rotation (in the same direction) of the rest of the strips, is achieved.

In this way it is possible to place all the strips in the extreme horizontal position (FIG. 2), in which all the direct luminous radiation that strikes the blind 10 remain practically non-screened, or in the extreme practically vertical configuration (FIG. 3) in which the amount of direct luminous radiation that can pass through the said blind is nil. It is naturally possible to achieve any midway position between the above mentioned extreme positions.

In the event of it being wished to stabilize a plurality of the aforementioned positions, use is made of a clamp 13 provided, along the lateral edges thereof, with serrations 13*a*. One extremity of the said clamp is integral with a collar 14 that is able to slide on a slender rod 15, the latter connecting the plates 7 belonging to the upper strip 6*a*.

The said clamp is able to mate with a hole 16 and remain engaged therewith in a plurality of combinations (defined by the aforementioned serrations), each of which defines (and stabilizes) a corresponding position in the said plurality of positions for the strips 6. The said hole 16 is defined by a "U" shaped element 17 fixed centrally at the top, to the upper side 3*a* of the said parallelogram.

The said element 17 has pivotally connected thereto a hook 18 (placed in the region of the upper side 2*a*) provided to allow the blind to be hung on a suitable bar.

The lower side 3*b* is secured to two removable blocks 19 that act as intermediate elements between the blind 10 and an eventual lower support surface.

Figure 4:
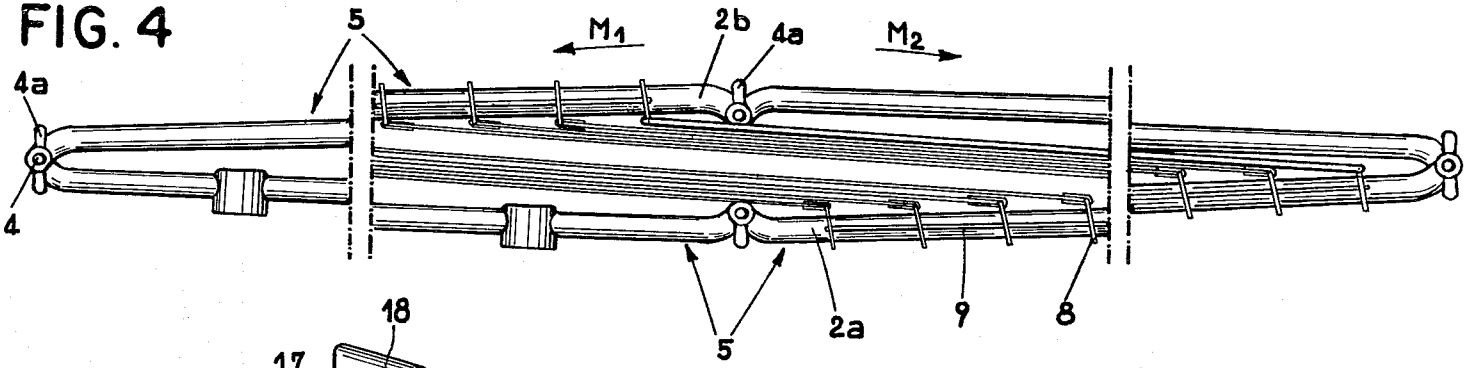
FIG. 4 illustrates, in a front view, the blind in its reduced volume configuration.

When it is wished to separate the blind from the corresponding glass (not illustrated), all that has to be done is to unhook the blind from its support, slacken the wing nuts 4*a* from the pivots 4, and then rotate the sides 2*a*–2*b* in the direction $M_1$ (or $M_2$) in such a way as to place the said parallelogram in the configuration shown in FIG. 4.

Figures 1, 2, 3:
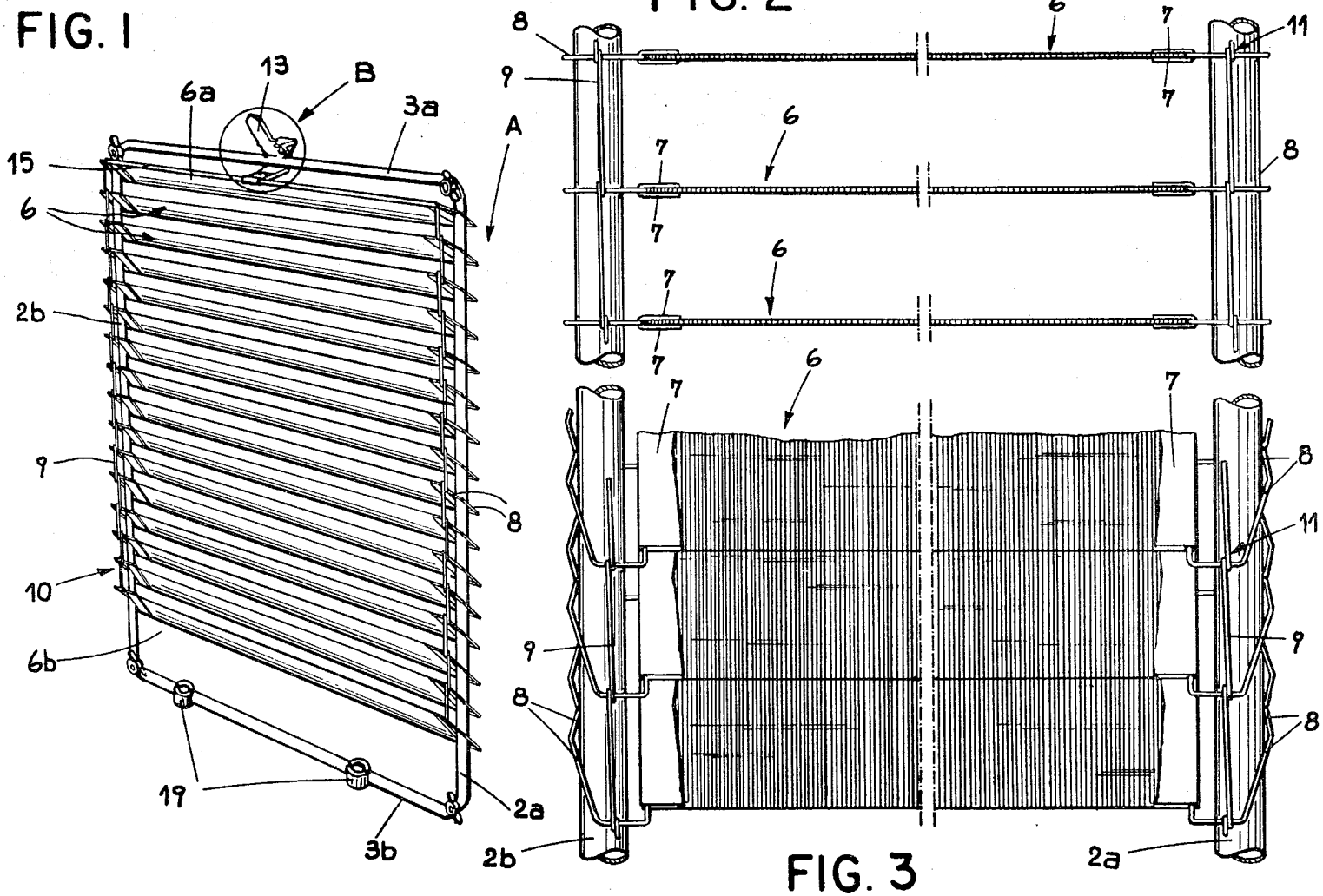
FIG. 1 illustrates a perspective view of the blind in question in its operational configuration.
FIGS. 2 and 3 illustrate, in a front view, one part of the blind in the configuration as per the preceding figure, with the strips in a horizontal and in a practically vertical position, respectively.

In the said configuration, the distance the plates 7 belonging to one and the same strip are apart, is less than the distance between the said plates when the said strip is positioned as in FIG. 1. This is due to the face of provision having been made for the extremities of the arms 2*a*–2*b* and 3*a*–3*b* (in which the pivots 4 are provided) to be bent towards the inside of the parallelogram.

With the aforementioned constructional detail it is possible to maintain the strips 6 taut in the operational configuration of the blind (FIG. 1), but not to maintain the said strips under tension (and the rods 8 not mechanically stressed) when in the reducible volume configuration of the blind (FIG. 4).

The limited volume occupied by the blind 10 in its reduced volume configuration is advantageous both for conveying and storing the said blind, and it is also advantageous for the preparation of the wrapped blinds destined to the purchasers because of the limited volume of the container designed to accept the blind.

It is understood that the foregoing description, given purely as an unlimited example, can be varied, adapted or combined without, in any way, deviating from the framework of protection afforded to the invention as described above and claimed below.

What is claimed is

1. Reducible volume sun-blind comprising: an articulated parallelogram that defines a support frame for the blind; means for stabilizing the said parallelogram in any one of a plurality of configurations; a plurality of parallel strips having extremities rotatably connected, with respect to longitudinal axes of the individual strips, to two parallel sides of the parallelogram; elastic means for tensioning the said strips interposed between at least one extremity of said strips and the relevant side of the parallelogram; means responsive to a manual force on one of said blinds and positioned within the outer extremities of said parallelogram for synchronously rotating the said strips, with respect to their longitudinal axes, from a position in which surfaces of said strips are practically coplanar with the surface defined by the said parallelogram to a position in which the surfaces of the strips are approximately perpendicular thereto; and means for stabilizing the said strips in a desired one of a plurality of positions, said means for stabilizing extending between one of said strips and one of the sides of the parallelogram to thereby fix the orientation of the strips with respect to the parallelogram.

2. Blind according to claim 1, wherein the extremities of the sides of the said parallelogram are bent slightly towards the inside of the said parallelogram.

3. Blind according to claim 1, wherein the elastic means is constituted by at least two rods, made of flexible elastic material, one extremity of each rod being connected to the corresponding extremity of the strip, and the other extremity being bent and freely inserted in a corresponding hole means in the relevant side of the parallelogram, the said rods being placed symmetrically with respect to the longitudinal axis of the said strip.

4. Blind according to claim 3, wherein the means for synchronously rotating the said strips is constituted by a wire, connected at its extremities with the extremities, located on one and the same side, of the first and last strip in the said plurality of strips, the said wire being bent in such a way as to define a plurality of slots designed to freely accept the said rods, located on one and the same side, relating to intermediate strips in the said plurality of strips, said rods located on one and the same side being inserted through said slots so the movement of one of said strips about its longitudinal axis results in simultaneous movement of all of said strips.

5. Blind according to claim 4, comprising at least one slender rod that joins extremities of one of the two furthermost strips in the said plurality of strips, the means for stabilizing the said strips being constituted by at least one clamp provided with serrated edges, connected to the said slender rod in a way that allows sliding of the clamp on the rod, the said clamp mating and remaining engaged, in a plurality of positions each of which defines one corresponding position in that said plurality of positions, with a seating made in the side of the said parallelogram that is parallel and closest to the said slender rod.

6. Blind according to claim 1, wherein the said means for stabilizing the said parallelogram in any one of its configurations, is constituted by at least two nuts, each of which screw couples with a corresponding pivot in the said parallelogram.

7. A reducible volume sun-blind comprising:

a support frame defined by an articulated parallelogram comprised of first and second pairs of parallel side members, the support frame being movable between an erect position defining a rectangular frame and a collapsed position;

means for releasably locking said side members in desired positions, the support frame in the erect position having the first pair of the side members extending vertically, each of the first pair having spaced holes provided along the lengths thereof;

a plurality of elongate strips formed of flexible material and having rigid U-shaped plates connected to end extremities of the flexible material;

a pair of metal rods for connecting each plate to a respective one of said first pair of side members, each rod having a first extremity connected to said U-shaped rod and a second extremity bent to form a hook inserted into one of said spaced holes, the pair of rods being symmetrical with respect to a longitudinal axis of the strip, said rods being shaped to exert tension on the strips in the erect position of the frame and to provide pivot connections between the strips and the first pair of side members;

a metal wire extending parallel to the first pair of side members and having end extremities connected to rods associated with outermost ones of said strips, intermediate portions of said metal wire being bent to define slots encompassing rods associated with strips intermediate the outermost strips so that movement of one of said strips by direct manual pressure results in conjoint movement of all of said strips, said strips being movable between first extreme positions passing substantially all direct luminous radiation and second extreme positions blocking substantially all direct luminous radiation; and means for clamping said strips in one of a plurality of positions comprising a connecting rod interconnecting the plates of one of the outermost strips, a clamp supported by said connecting rod, and means carried by one of the second pair of said side members engageable by said clamp for holding said strips in a desired position.

8. A sun-blind in accordance with claim 7, wherein the distance between the first pair of the side members in the erect position is greater than the distance therebetween in the collapsed position so that tension exerted on the strips by the rods is reduced when the support frame is in the collapsed position.

9. A sun-blind in accordance with claim 7 or 8, wherein a metal wire is provided adjacent each of the first pair of side members.

* * * * *